United States Patent [19]

Wheelwright

[11] 4,394,028

[45] Jul. 19, 1983

[54] SKATE

[76] Inventor: Joseph S. Wheelwright, 551 Tremont St., Boston, Mass. 02116

[21] Appl. No.: 243,445

[22] Filed: Mar. 13, 1981

[51] Int. Cl.[3] ..... A63C 17/04

[52] U.S. Cl. ..... 280/11.19; 280/11.2; 280/11.28

[58] Field of Search ..... 280/11.2, 11.21, 11.25, 280/11.23, 11.19, 11.1 BT, 11.27, 11.28, 87.04 R

[56] References Cited

U.S. PATENT DOCUMENTS

| | | | |
|---|---|---|---|
| 138,018 | 4/1873 | Gregg | 280/11.19 |
| 584,089 | 6/1897 | Buttermilch | 280/11.23 |
| 1,017,162 | 2/1912 | Naumann | 280/11.2 |
| 1,393,813 | 10/1921 | Muck | 280/11.19 |
| 1,728,063 | 9/1929 | James | 280/11.23 |
| 1,751,942 | 3/1930 | Nanz | 280/11.25 |
| 2,048,916 | 7/1936 | Bentzlin | 280/11.2 |
| 2,725,238 | 11/1955 | Day | 280/11.2 |
| 3,008,725 | 11/1961 | Stites | 280/11.2 |
| 3,823,952 | 7/1974 | Kukulowicz | 280/11.2 |

FOREIGN PATENT DOCUMENTS

| | | | |
|---|---|---|---|
| 853981 | 4/1940 | France | 280/11.2 |

*Primary Examiner*—David M. Mitchell

[57] ABSTRACT

A roller skate comprising a foot-supporting plate having a normally-raised rear brake wheel, which brake wheel is activated by tilting the plate backwardly, the plate being supported at a low center of gravity between a pair of side wheels and having an extendable front wheel, which front wheel and brake wheel being adjustable to suit the individual skater in terms of skate stability and braking action.

17 Claims, 7 Drawing Figures

FIG 1
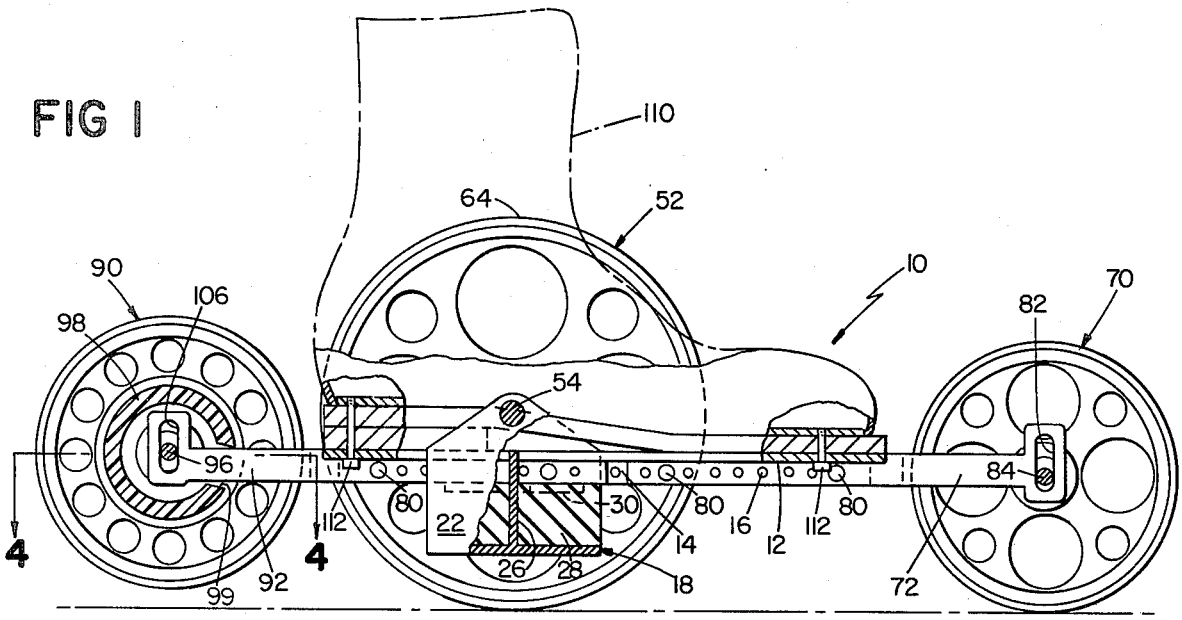
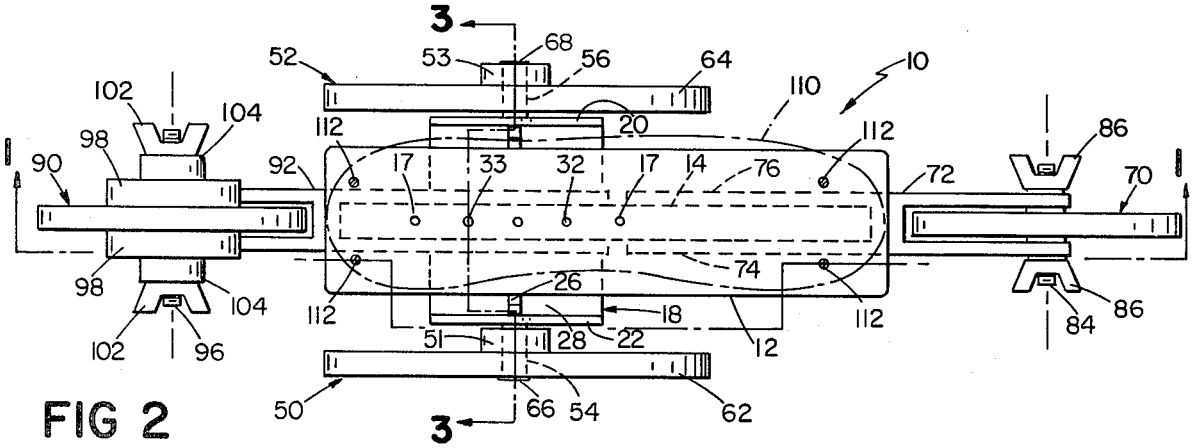
FIG 2

FIG 3
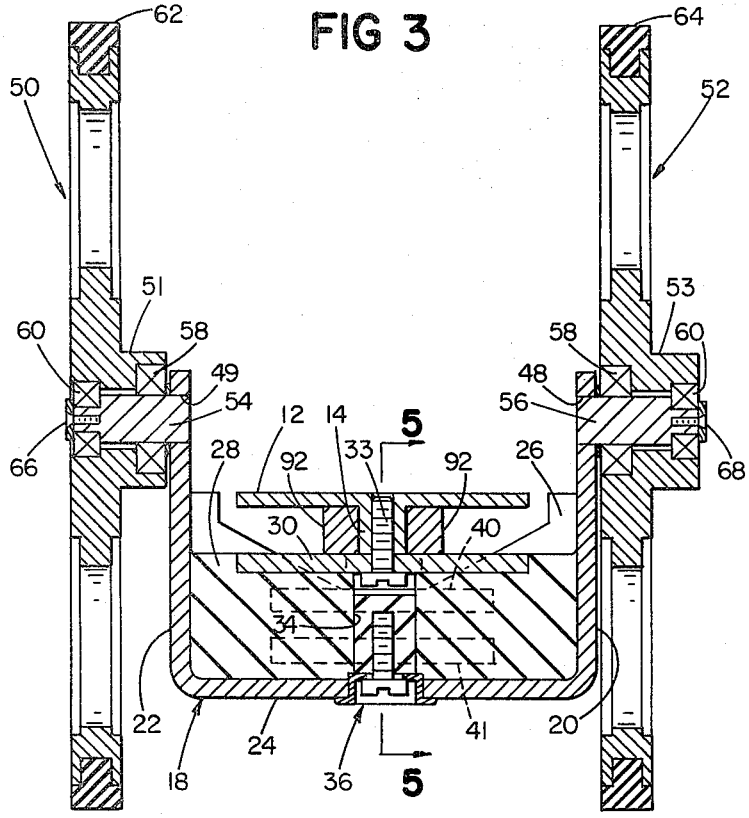
FIG 4
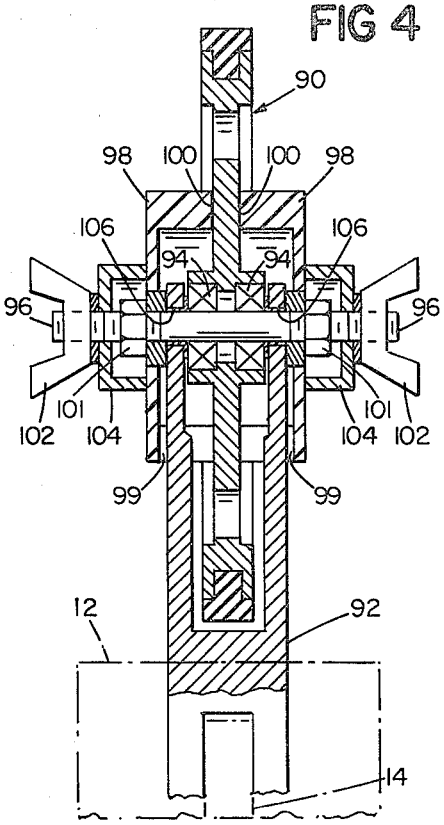
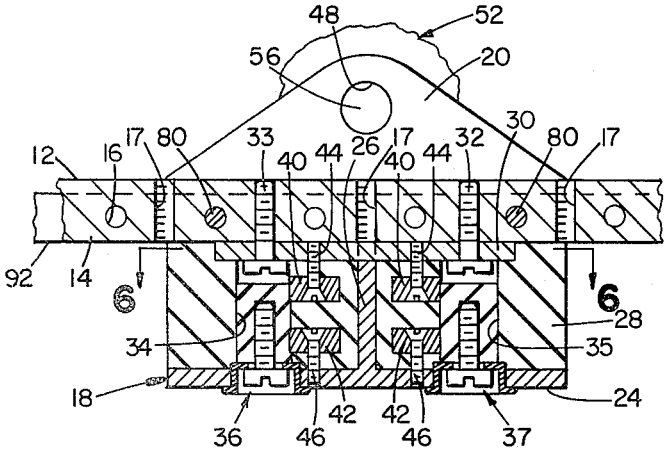
FIG 5
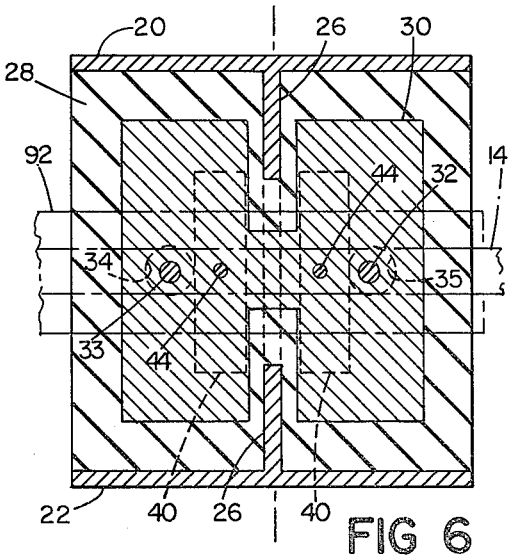
FIG 6
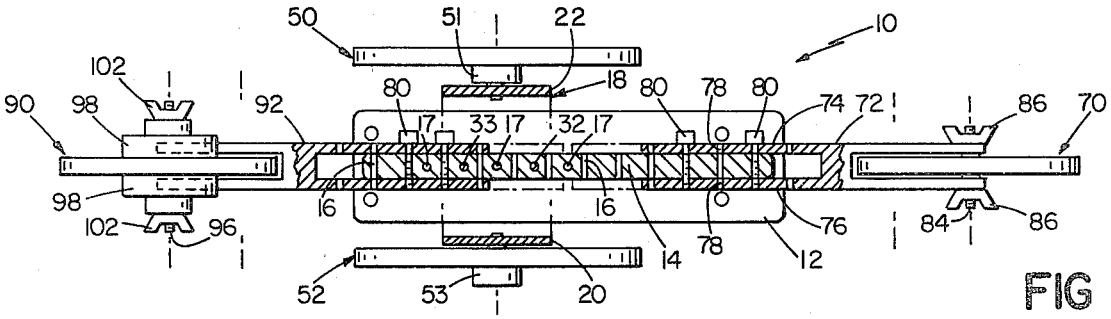
FIG 7

SKATE

FIELD OF THE INVENTION

This invention relates to roller skates.

BACKGROUND OF THE INVENTION

Roller skates are well known in the prior art, and they generally comprise a pair of boots or metal shoe-attaching plates, each usually mounted on two sets of wheels respectively disposed under the heel and toe areas of the boots or plates. At least for adult skates, the individual wheels are attached to their axles by means of ball bearings and the like so that the wheels turn as frictionlessly as possible. As a result, the skater is able to achieve a substantial rate of speed when using such skates.

One of the most important drawbacks of the prior art skates is that despite their design for speed they do not have any braking mechanism, as the skate braking mechanisms known to the art are ineffective or difficult to use. Also, the prior art skates cannot be adjusted to suit the different levels of skill of different skaters, and thus, particularly in the case of adult skaters, a novice must use skates which are actually designed for an expert. Finally, turning is somewhat difficult with the prior art skates, and as most have a high center of gravity, it is fairly easy to fall while making a turn. This problem is compounded somewhat in that the prior art skates lack any shock-absorbing capacity so that the jarring effect from rolling over bumps or cracks is transmitted to the foot and legs, which at best is uncomfortable and at worst could cause the skater to lose control, particularly in a turn.

SUMMARY OF THE INVENTION

I have discovered an improved roller skate which has an effective, easily-operated brake, and which skate and brake can be adjusted to suit an individual skater. In addition, my skate has a low center of gravity, is easy to turn, and absorbs shocks which would otherwise be transmitted to the foot.

In a preferred embodiment, a roller skate comprises a foot-supporting plate mounted between a pair of large side wheels. A brake wheel, having an adjustable amount of drag, extends from the rear of the plate, and when the skater tilts his foot backwardly, the brake wheel contacts the ground, thereby stopping the skate. A small front wheel extends forward from the plate, the distance between the front wheel and plate as well as between the brake wheel and the plate is adjustable to suit the individual skater. The foot-supporting plate is connected to a shock-absorbing material and is tiltable so as to allow a skater to turn by swinging his knees like a skier. Further, the plate is arranged so that its center of gravity is low with respect to the side wheels to increase stability.

DESCRIPTION OF A PREFERRED EMBODIMENT

The structure and operation of a preferred embodiment of the invention will now be described, after first briefly describing the drawings.

DRAWINGS

FIG. 1 is a side view in partial section of a roller skate of this invention,

FIG. 2 is a top view of the skate of FIG. 1,

FIG. 3 is a view taken along lines 3—3 of FIG. 1,

FIG. 4 is a view taken along lines 4—4 of FIG. 1,

FIG. 5 is a view taken along lines 5—5 of FIG. 3,

FIG. 6 is a view taken along lines 6—6 of FIG. 5, and

FIG. 7 is a bottom view in partial section of the skate of FIG. 1.

STRUCTURE

Referring to FIGS. 1 and 2, a roller skate according to the invention herein is shown at 10. Roller skate 10, which is a left skate, generally comprises a foot-supporting plate 12, inboard and outboard large side wheels 50, 52, a small forward wheel 70 and a rear brake wheel 90.

Plate 12 has a narrow frame 14 extending almost the entire length of its underside along its longitudinal axis, as best shown in FIG. 7. Frame 14 has a series of holes 16 spaced along its entire length at intervals of about an inch. These holes 16 extend laterally through the frame 14. Between some of the lateral holes 16 in the rear portion of the frame 14, the frame 14 also has a few bolt holes 17 extending vertically therethrough. The vertical bolt holes 17 also extend through the plate 12. The plate 12 and the frame 14 are integral and made of aluminum.

As shown in FIG. 3, plate 12 is supported by a U-shaped bracket 18 slung between side wheels 50, 52. Bracket 18 has a pair of vertical walls 20, 22 and a bottom wall 24, and a central wall 26 extends across the bracket 18 between the vertical walls 20, 22. The connected compartments formed by the walls 20, 22, 24 on each side of the central wall 26, which has a midsection of low height, are partially filled with a compression pad 28 made of a stiff elastomer, e.g., neoprene or rubber urethane.

Pad 28 has an H-shaped plate 30, best shown in FIG. 6, embedded in its top surface, and bolts 32, 33 connect the pad plate 30 to the foot-supporting plate 12, as shown in FIG. 5. In order to permit access to bolts 32, 33, for purposes to be hereinafter explained, a pair of holes 34, 35 extend through the bottom wall 24 and pad 28 to the bolts 32, 33. The holes 34, 35 are sealed by removable plugs 36, 37. Two pair of smaller plates 40, 42, all rectangular, are also embedded in pad 28. Upper pair of plates 40 are connected by bolts 44 to H-shaped plate 30, and lower pair of plates 42 are connected by bolts 46 to bottom wall 24 of bracket 18.

Bracket 18 is connected to inboard and outboard side wheels 50, 52 by axles 54, 56, respectively. Axles 54, 56 extend through axle holes 48, 49, in the bracket 18, and the axles 54, 56 are soldered to the upper portion of bracket sidewalls 20, 22. Each side wheel is mounted on an identical pair of bearings 58, 60, which are Hoover 77R8 and 77R4A, respectively, and the wheels are held on the axles by removable caps 66, 68. Wheels 50, 52 which are aluminum and about 8 inches in diameter, have treads 62, 64 of rubber. The side wheels also have hubs 51, 53, but the hub 51 of inboard wheel 50 is disposed towards the bracket 18, while hub 53 of outboard wheel 52 is disposed away from it. For the right skate (not shown), the hub arrangement would be the same.

Front wheel 70, which is about 6 inches in diameter, is mounted on a yoke 72 which has a pair of rearwardly-extending arms 74, 76, as best shown in FIG. 7. Arms 74, 76 are spaced apart at a distance slightly wider than the width of the frame 14. A series of lateral holes 78 extend through the arms, and when the yoke 72 is in place, the arm holes 78 match up with the lateral holes 16 of the frame 14. The yoke 72 is held in place on the frame 14 by aligning the holes 16, 78 and inserting a pair of bolts 80 through two the aligned holes. As shown in FIG. 1, yoke 72 also has a vertical axle slot 82 for an axle 84 of wheel 70. Wing nuts 86 hold the axle 84 in a fixed vertical position in the slot 82.

Rear brake wheel 90 is mounted on a yoke 92 which is connected to the plate 12 in the same manner as the yoke 72 of the front wheel 70. As shown in FIG. 4, rear wheel 90 is mounted on an axle 96, the ends of which are screw threaded. A pair of bearings 94 support the wheel 90 on the axle 96. A pair of brake drums 98 are mounted on the axle 96, one on each side of the wheel 90 so that a face 100 of each drum contacts the side of wheel 90. Brake drums 98 are held on the axle by nuts 101. Drums 98 have a notch 99, which fits around yoke 92, as shown best in FIG. 1, so that yoke 92 prevents any rotation of the drums 98. A pair of cylindrical cups 104 are held in place on the axle by wing nuts 102. Pressure cups 104, which ride against the outside of drums 98, are also mounted on the axle 96. As with the front wheel 70, axle 96 rides in a vertical slot 106 in the yoke 92.

A boot 110 is attached to plate 12 by bolts 112. Other fastening means are also possible. As shown in FIG. 1, in the normal configuration of the skate 10, the skate and boot 110 are inclined slightly with the rear wheel 90 raised off the ground.

OPERATION

The roller skate is used by adjusting the wheels and brake to suit the particular skater. The position of the side wheels 50, 52 with respect to the plate 12 can be adjusted by loosening bolts 32, 33 (after plugs 36, 37 are removed) and moving the bracket 18 axially along frame 14 to insert bolts 32, 33 through another pair of bolt holes 17. Generally the bracket 18 will be attached as shown at the point slightly to the rear of the midpoint of the plate. The bolts 32, 33 are then tightened through the holes 17 selected and the plugs 36, 37 reinserted.

The front wheel 70 is adjusted by releasing bolts 80 from frame 14 and moving the yoke 72 along frame 14 to align different sets of yoke holes 78 and frame holes 16. The greater the wheel 70 extends in front, the better the stability. The front wheel 70 is also adjusted vertically by moving the axle 84 vertically in slot 82 and tightening wing nuts 86 when the axle is at the desired height. A low setting of the axle will cause more of a forward lean to the skater, a position which is more condusive to higher speed.

The rear brake wheel 90 is similarly adjustable by the skater both axially and vertically. As explained above, the normal vertical positioning of axle 96 in slot 106 is such that the wheel 90 does not contact the ground. When the skater wishes to slow or stop, he merely tilts his feet backwards slightly. This causes the front wheel 70 to be lifted, and the rear wheel 90 contacts the ground. As the rotation of rear wheel 90 is restricted by the friction created by the brake drums 98 on the wheel 90, the resulting drag causes the skater to slow and stop. This breaking effect can be increased or decreased by tightening or loosening the wing nuts 102 which force the pressure cups 104 against the brake drums 98 and the surface 100 of the drums 98 against the wheel 90. The wing nuts 102 may also be loosened so that no frictional relationship exists and wheel 90 provides no braking action. The speed at which the brake is engaged (i.e., the amount of rearward foot tilt required) depends on the setting of the height of the axle 96 and the location of the bracket 18 with respect to the plate 12. A novice, for example, may set the axle height as low as possible for more rapid brake engagement. Also, the novice might move the bracket 18 forward with respect to the plate 12. Although this increases the forward tilt of the plate and raises the rear wheel slightly, less tilt of the foot would be required to engage the brake.

The skater easily maintains balance with this skate as result of forward extension of front wheel 70 and the fact that foot-supporting plate 12 is essentially level with the center of gravity for the side wheels 50, 52, i.e., the bottom of the skater's foot rides at or below the center of the side wheels rather than completely above the wheels, as with most roller skates.

Turning with the skate is facilitated by compressible pad 28, which allows the skater to lean and shift his weight toward the direction of turning, e.g., like a skier or, more particularly, like a cyclist, without losing stability by having the side wheels 50, 52 and front wheel 70 lose contact with the ground. This is because pad 28 allows tilting movement of plate 30. When turning in this manner, the outboard foot controls the turn and the outboard leg swings inwardly. The inboard leg remains generally perpendicular. Because of this leg tilting toward the inboard wheel (wheel 50 in this case as a left skate is shown), the inboard side wheel 50 is extended away from foot plate 12 by protruding hub 51. In addition, compression pad 28 acts as a shock absorber.

OTHER EMBODIMENTS

Other embodiments are within the following claims. For example, other flexible means may be employed to connect the side wheel section to the support frame. Also, this invention may be used as a skateboard without a boot.

Other variations will occur to those skilled in the art.

What is claimed is:

1. A roller skate comprising a foot supporting plate carrying means for engaging a human foot thereon, a front wheel carried by a yoke fixedly connected to said plate, said front wheel extending above said plate and being in front of said means for engaging, a pair of side wheels mounted on both sides of said plate and extending above said plate, means for suspending said plate on said side wheels for lateral tilting motion of said plate and said front wheel relative to said side wheels, and brake means comprising a rear brake wheel secured to the rear of said plate and activated by movement of a skater's foot, whereby said plate and front wheel can be tilted as a skater leans during turning while said front and side wheels remain on the ground.

2. The roller skate of claim 1 wherein said brake wheel is positioned in contact with the ground when said brake means is activated, and out of contact with the ground when said brake means is not activated.

3. The roller skate of claim 2 further comprising means for adjusting the height of said brake wheel relative to said plate.

4. The roller skate of claim 2 further characterized in that said brake means is activated by tilting said plate so that said brake wheel contacts the ground.

5. The roller skate of claim 4 wherein said brake wheel is disposed to the rear of said plate and said plate is tilted rearwardly to place said brake wheel in contact with the ground.

6. The roller skate of claim 5 wherein said brake wheel is mounted on a yoke attached to said plate, further comprising means for extending said yoke so as to selectively vary the distance between said brake wheel and said plate.

7. The roller skate of claim 1 wherein said yoke is attached to said plate and is extendable so as to selectively vary the distance between said front wheel and said plate.

8. The roller skate of claim 7 further comprising means for adjusting the height of said front wheel relative to said plate.

9. The roller skate of claim 1 wherein said plate is disposed at level with approximate center of said side wheels.

10. The roller skate of claim 9 further comprising means for selectively attaching said side wheels to said plate at various longitudinal locations on said plate.

11. The roller skater of claim 1 wherein one of said side wheels is an inboard wheel, which inboard wheel is set away from said plate by a hub means.

12. The skate of claim 1 wherein said means for suspending includes means for cushioning shocks.

13. A roller skate comprising a foot supporting plate carrying means for engaging a human foot thereon, pair of wheels mounted on both sides of said plate about a side wheel axis and extending above said plate, and a front wheel carried by a yoke fixedly connected to said plate, said front wheel extending above said plate and being in front of said means for engaging, means for adjusting the height of said front wheel relative to said plate to adjust the angle of said plate and foot in use, a brake wheel secured to the rear of said plate and activatable by pivoting of said plate about the side wheel axis, and means to adjust the position of said brake wheel to engage the ground in response to different amounts of pivoting, whereby the angle of the plate is adjustable to accomodate persons of different levels of skill at different speeds, and the brake position is adjustable in response to different plate angles and to the desired sensitivity of the user.

14. The roller skate of claim 13 wherein said means for adjusting the height is a front wheel axle, the height of said axle being adjustable with respect to said yoke.

15. The roller skate of claim 14 further comprising means for extending said yoke to selectively vary the distance between said front wheel and said plate.

16. The roller skate of claim 13 further comprising means for selectively attaching said side wheels to said plate at various longitudinal locations on said plate.

17. The roller skate of claim 13 wherein one of said side wheels is an inboard wheel, which inboard wheel is set away from said plate by a hub means.

* * * * *